US005613519A

United States Patent [19]

Ishizaki

[11] Patent Number: 5,613,519

[45] Date of Patent: Mar. 25, 1997

[54] OPERATING VALVE ASSEMBLY WITH PRESSURE COMPENSATION VALVE

[75] Inventor: Naoki Ishizaki, Kanagawa, Japan

[73] Assignee: Kabushiki Kaisha Komatsu Seisakusho, Japan

[21] Appl. No.: 446,839

[22] PCT Filed: Dec. 22, 1993

[86] PCT No.: PCT/JP93/01861

§ 371 Date: Jun. 1, 1995

§ 102(e) Date: Jun. 1, 1995

[87] PCT Pub. No.: WO94/15103

PCT Pub. Date: Jul. 7, 1994

[30] Foreign Application Priority Data

Dec. 22, 1992 [JP] Japan ..... 4-341996

[51] Int. Cl.[6] ..... F17D 1/00; F15B 11/08

[52] U.S. Cl. ..... 137/596.2; 137/596.14; 91/447; 91/461

[58] Field of Search ..... 137/596.2, 596.14; 91/446, 447, 461, 517

[56] References Cited

U.S. PATENT DOCUMENTS

| | | | |
|---|---|---|---|
| 3,596,566 | 8/1971 | Krehbiel | 91/447 X |
| 3,884,123 | 5/1975 | DeVita et al. | 91/447 |
| 4,154,262 | 5/1979 | Blume et al. | 91/446 X |
| 5,146,747 | 9/1992 | Sugiyama et al. | 91/446 X |
| 5,273,069 | 12/1993 | Akiyama et al. | 91/447 X |

FOREIGN PATENT DOCUMENTS

| | | |
|---|---|---|
| 62-147101 | 7/1987 | Japan . |
| 281902 | 5/1990 | Japan . |
| 4136508 | 5/1992 | Japan . |

*Primary Examiner*—Hoang Nguyen
*Attorney, Agent, or Firm*—Ronald P. Kananen

[57] ABSTRACT

An operating valve assembly with a pressure compensation valve, comprises a spool for selectively establishing and blocking communication between a pump port, an output port and a main tank port, being disposed within a spool bore of a valve body, and a pressure compensation valve being provided between the output port and the actuator port. The pressure compensation valve has a piston pressed in the closing side by a load pressure acting on a compensation pressure acting portion, and a valve provided integrally with the piston for selectively establishing and blocking communication between the output port and the actuator port, and actuated for opening by the output port pressure acting on a portion to be compensated, the compensation acting area being equal to the area to be compensated. A pilot valve for selectively establishing and blocking communication of a pressure receiving portion of the piston of the pressure compensation valve with a tank, and a shuttle valve supplying the pressure of higher pressure side among the load pressure and the actuator port pressure to a compensation pressure acting portion of the pressure compensation valve, are provided.

3 Claims, 2 Drawing Sheets

OPERATING VALVE ASSEMBLY WITH PRESSURE COMPENSATION VALVE

FIELD OF THE INVENTION

The present invention relates to an operating valve assembly with a pressure compensation valve.

BACKGROUND ART

An operating valve is known in which a spool is disposed in a spool bore of a valve body for selectively establishing and blocking communication between a pump port, an actuator port and a tank port. In such operating valve, fluid leakage from the actuator port to the tank port is blocked by the fitted portion between the spool bore and the spool so that a holding pressurized fluid in the actuator may not flow to a tank. In this case, by reducing a gap in the fitted portion between the spool bore and the spool, leakage of the holding pressurized fluid in the actuator port may be prevented to a certain extent. However, since a smaller gap may cause greater sliding resistance of the spool, a greater operation force becomes necessary.

Therefore, in the prior art, a lock valve is provided in a line connected to the actuator or at another appropriate position. However, such arrangement inherently causes high cost.

On the other hand, in Japanese Unexamined Patent Publication (Kokai) No. Showa 62-147101, there is proposed an operating valve which is provided with a pressure compensation valve capable of preventing fluid leakage from the actuator port to the tank port.

However, in the operating valve having the pressure compensation valve, a cut-out in the spool is large to make it impossible to assuredly avoid leakage of the holding pressurized fluid in the actuator port to the tank.

Therefore, it is an object of the present invention to provide an operating valve assembly with a pressure compensation valve which can make a required operation force for a spool small and can assuredly prevent leakage of a holding pressurized fluid acting on an actuator port to a tank.

DISCLOSURE OF THE INVENTION

The present invention has been developed in view of the points set forth above. In order to accomplish the above-mentioned and other objects, according to one aspect of the invention, an operating valve assembly with a pressure compensation valve, comprises:

a spool for selectively establishing and blocking communication between a pump port, an output port and a main tank port, being disposed within a spool bore of a valve body, and a pressure compensation valve being provided between the output port and an actuator port, the pressure compensation valve having a piston pressed in the closing side by a load pressure acting on a compensation pressure acting portion, and a valve provided integrally with the piston for selectively establishing and blocking communication between the output port and the actuator port, and actuated for opening by the output port pressure acting on an area of a portion to be compensated, an area of the compensation acting area pressure acting portion being equal to the area to be compensated, and a pilot valve for selectively establishing and blocking communication of a pressure receiving portion of the piston of the pressure compensation valve with a tank, and a shuttle valve supplying the pressure of a higher pressure side among the load pressure and the actuator port pressure to the compensation pressure acting portion of the pressure compensation valve.

With the construction set forth above, in the state where the pump port, output port and the main tank port are blocked, namely at the neutral position of the spool, the pressure of the actuator port acts on the compensation pressure acting portion of the pressure compensation valve. Then, the piston is pressed toward the position to lock communication between the actuator port and the output port by the valve. Thus, the pressurized fluid in the actuator port will not flow to the output port. Therefore, the pressurized fluid in the actuator port will not leak through the gap between the spool bore and the spool.

Accordingly, the gap between-the spool bore and spool can be made greater to make the operating force for the spool smaller. Also, leakage of the holding pressurized fluid acting on the actuator port can be prevented.

It is preferred that the pilot valve is associated with the spool and is placed at the communicating position when the output port is communicated with the tank port.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

BEST MODE FOR IMPLEMENTING THE INVENTION

The preferred embodiment of an operating valve assembly according to the present invention will be discussed hereinafter with reference to FIGS. 1 and 2.

Figure 1:
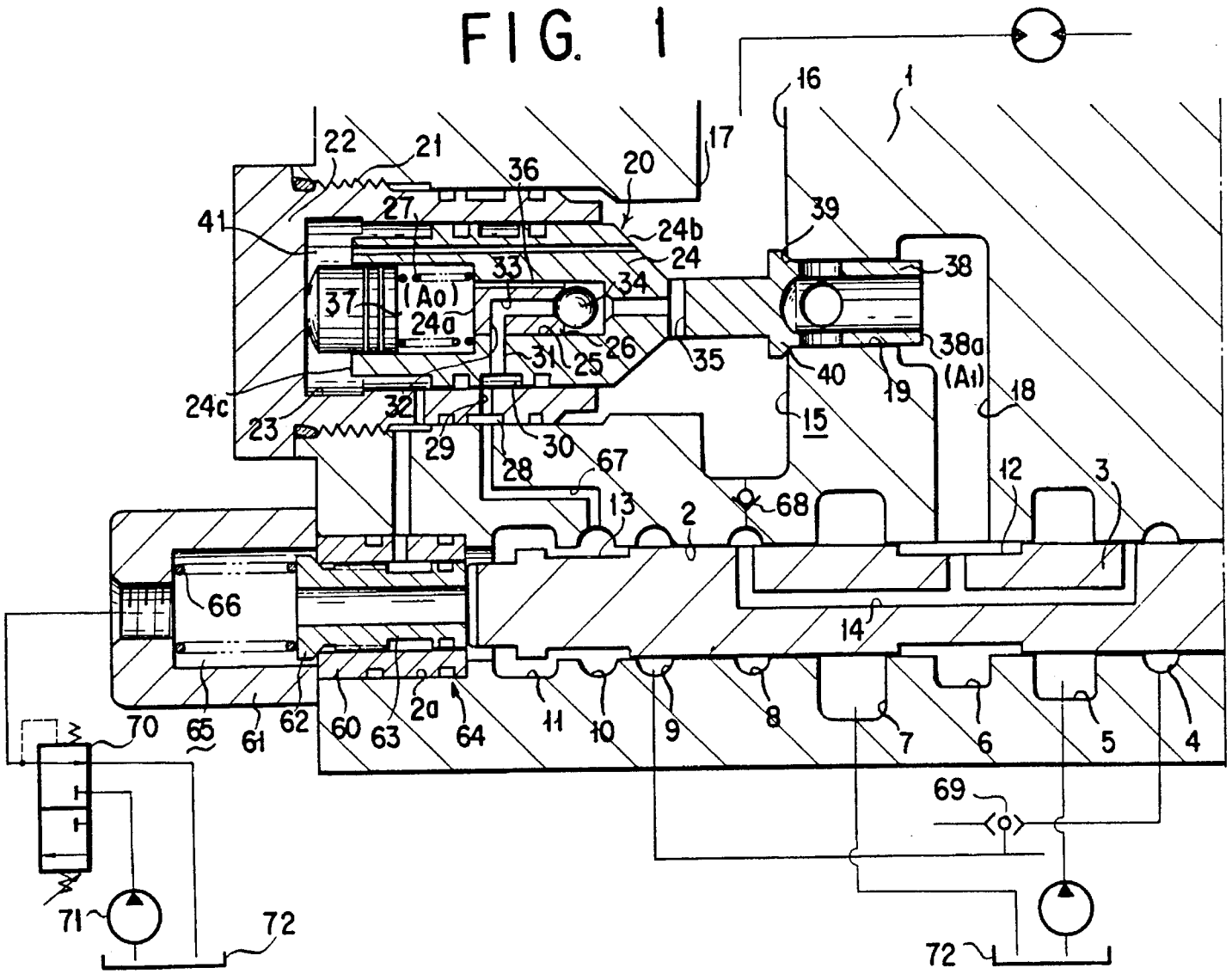
FIG. 1 is a detailed section of the left half of one embodiment of an operating valve assembly according to the invention.
Figure 2:
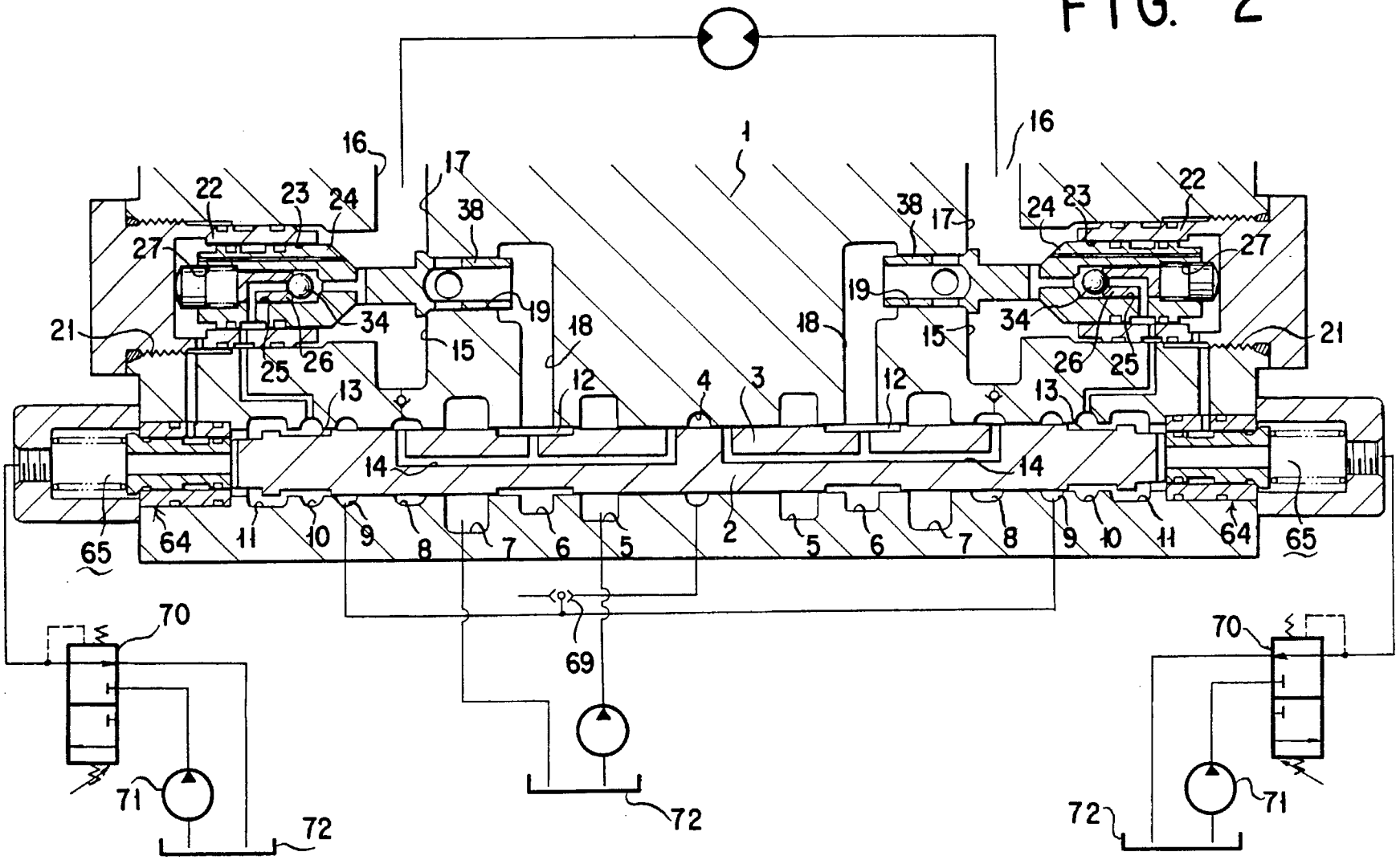
FIG. 2 is a section of the whole construction of the embodiment.

As shown in FIGS. 1 and 2, a spool 3 is disposed in a spool bore 2 of a valve body 1. In the spool bore 2, a load pressure detection port 4, a pump port 5, an output port 6, a main tank port 7, an intermediate port 8, a load pressure input port 9, a load pressure output port 10, and a tank port 11 are formed in order in a longitudinally spaced apart relationship. Also, in the spool 3, a first small diameter portion 12 for selectively establishing and blocking communication between the pump port 5 and the output port 6 and between the output port 6 and the main tank port 7, and a second small diameter portion 13 for selectively establishing and blocking communication of the load pressure output port 10 with the load pressure input port 9 and the tank port 11. The first small diameter portion 12 is communicated with the load pressure detection port 4 and the intermediate port 8 via a fluid conduit 14 formed in the spool 3.

The output port 6 is communicated with a second passage 18. The second passage 18 is communicated to a first passage 17 via a communication passage 19. The first passage 17 is communicated with the actuator port 16 and a passage 15. A pressure compensation valve 20 is provided in the passage 15.

The pressure compensation valve 20 has a sleeve 22 fixedly fitted in a mounting bore 21 opening to the first passage 17 of the valve body 1. In a blind bore 23 of the sleeve 22, a piston 24 is disposed. A member 26 is press fitted in a blind bore 25 formed in the piston 24. A spring 27 is disposed between the bottom of the blind bore 23 of the sleeve 22 and the piston 24. Also, an annular space 28 between the mounting bore 21 and the sleeve 22 is communicated with the blind bore 25 for the member 26 via an orifice 29, an annular groove 30, a bore 31 and a bore 32. A ball 34 is disposed in the blind bore 25 so that a higher pressure between the pressure of the actuator port 16, introduced from a fluid bore 35 of the piston 24, and the pressure introduced from the annular space 28 is supplied to a spring chamber 37 via a slit 36 of the member 26. Namely, with the ball 34, a fluid bore 33 and the fluid bore 35, a shuttle valve is formed.

In the piston 24, a valve 38 is provided integrally. The valve 38 is slidably engaged to the communication hole 19. The valve 38 has a cone seat 40 abutting onto a valve seat 39 under pressure, integrally. The spring force of the spring 27 and the pressure supplied to the spring chamber 37, the piston 24 is pressed so that the cone seat 40 is pressed onto the valve seat 39. Thus, a lock valve blocking flow of the pressurized fluid from the actuator port 16 to the output port 6 can be formed.

The end portion 2*a* of the spool bore 2 is provided with a larger diameter. In the end portion 2*a*, a collar 60 is engaged. The collar 60 is held by a spring casing 61. In the collar 60, a piston 63 with a cone seat 62 is slidably disposed. By this, a pilot valve 64 is constructed as a whole. Then, the pilot valve 64 is adapted to selectively establish and block communication between the spring chamber 65 and a pressure receiving portion 41 of the pressure compensation valve 20. The piston 63 is pressed by a spring 66 to press the cone seat 62 onto the collar 60 to block communication between the spring chamber 65 and the pressure receiving portion 41. When the spool 3 is pressed toward the left, the piston 63 is pressed toward the left to release the cone seat 62 from the collar 60 to establish communication between the spring chamber 65 and the pressure receiving portion 41.

The spring chamber 65 is connected to the output side of a pilot valve 70 so that a pilot pressure is supplied to the spring chamber 65 by operating the pilot valve 70. The tank port 11 is communicated with the spring chamber 65. The load pressure output port 10 is communicated with the annular port 28 via a fluid conduit 67. The intermediate port 8 is communicated with the actuator port 16 via a check valve 68. The load pressure detection port 4 is communicated with the load pressure input port 9 via a shuttle valve 69.

It should be noted that FIG. 1 shows the left half of the operating valve. In practice, as shown in FIG. 2, the operating valve has another right half.

Next, the operation of the valve will be discussed.

When the spool 3 is in the neutral position, the pump port 5, the output port 6 and the main tank port 7 are blocked as shown in FIG. 1. The load pressure output port 10 is communicated with the tank port 11 via the second diameter portion 13, and also communicated with a tank 72 via the spring chamber 65, the pilot valve 70 and a pump 71. When the piston 63 of the pilot valve 64 is pressed by the spring 66, the cone seat 62 is pressed onto the collar 60 to block communication between the spring chamber 65 and the spring chamber 37.

By this, the pressure (i.e., the holding pressure) of the actuator port 16 is introduced into the spring chamber 37 via the port 35 and the slit 36 to shift the piston 24 toward the right. By this, the cone seat 40 of the valve 38 is pressed onto the valve seat 39 to block fluid flow of the pressurized fluid in the actuator port 16 to the side of the spool bore 2. Thus, the leakage of the holding pressurized fluid of the actuator port 16 is avoided.

It should be noted that the area of the closure side pressure receiving portion 24*a* for pressing the piston 24 toward the right, namely a compensation pressure acting area A0 of a compensation pressure acting portion becomes equal to the area of the pressure receiving portion 38*a* pressing the valve 38 in the opening side, namely an area A1 to be compensated.

Next, when the pilot pressure is supplied to the left side spring chamber 65 from the pilot valve 70, the spool 3 is shifted toward the right to establish communication between the pump port 5 and the output port 6 via the first small diameter portion 12. Also, the second passage 18 is communicated with the load pressure detection port 4 via the fluid conduit 14. The load pressure output port 10 is communicated with the load pressure input port 9 via the second small diameter portion 13.

By this, the load pressure flows from the load pressure detection port 4 to the shuttle valve 69 and thus compared with the load pressure from other actuator port. Thus, a higher one of the load pressures is input to the load pressure input port 9 and flows to the ball 34 via the load pressure output port 10 and a fluid conduit 67 to be compared with the pressure of the actuator port 16 introduced through the port 35. Among both pressures, a higher one of the pressures is introduced into the spring chamber 37 to press the piston 24 toward the right. Thus, pressure compensation is achieved together with the pump discharge pressure acting on the area to be compensated of the valve 38.

Namely, when the pressure of the actuator port 16 (its own load pressure) is lower than the other load pressure, the pressure compensation valve 20 performs pressure compensation with the higher other load pressure and its own load pressure. On the other hand, when the own load pressure is higher than the other load pressure, the pressure compensation valve merely serves as a check valve.

Next, when the spool 3 is shifted toward the left by supplying the pilot pressure to the right side spring chamber 65, the output port 6 is communicated with the main tank port 7 via the first small diameter portion 12. By pressing the piston 63 of the pilot valve 64 with the spool 3 against the spring 66, the cone seat 62 is released away from the collar 60 so that the pressure receiving portion 41 of the pressure compensation valve 20 is communicated with the spring chamber 65 and communicate with the tank 72 via the pilot valve 70. Therefore, the piston 24 is pressed toward the left by the pressure of the actuator port 16 acting on the opening side pressure receiving portion 24*b* of the piston 24. By this, the cone seat 40 of the valve 38 is released away from the valve seat 39 so that the pressurized fluid in the actuator port 16 is drained to the tank port 72 via the outlet port 6 and the main tank port 7.

As set forth above, in the condition where the pump port 5, the output port 6 and the main tank port 7 are blocked, namely the condition where the spool 3 is placed at the neutral position, the pressure in the actuator port 16 acts on the compensation pressure acting portion of the pressure compensation valve 20. Thus, the piston 24 is pressed in the closing side. Then the communication between the actuator port 16 and the output port 6 is blocked by the valve 38 so that the pressurized fluid in the actuator port 16 may not flow to the outlet port 6. Therefore, the pressurized fluid in the actuator port will not leak through a gap between the spool bore 2 and spool 3.

Accordingly, it becomes possible to provide a greater gap between the spool bore 2 and the spool 3 to make the operating force for the spool 3 smaller. Also, it becomes possible to prevent the holding pressurized fluid acting on the actuator port 16 from leaking to the tank 72.

Although the invention has been illustrated and described with respect to an exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

As set forth above, the operating valve assembly with the pressure compensation valve according to the present invention, is quite useful as a device for supplying the pressurized fluid to the hydraulic actuator.

What is claimed is:

1. An operating valve assembly with a pressure compensation valve, comprising:

a spool for selectively establishing and blocking communication between a pump port, an output port and a main tank port, said spool being disposed within a spool bore of a valve body, and a pressure compensation valve being provided between said output port and an actuator port, said pressure compensation valve having a piston pressed in the closing side by a load pressure acting on a compensation pressure acting portion, and a valve provided integrally with said piston for selectively establishing and blocking communication between said output port and said actuator port, and actuated for opening by the output port pressure acting on an area of a portion to be compensated, an area of said compensation pressure acting portion being equal to the area to be compensated, and a pilot valve for selectively establishing and blocking communication of a pressure receiving portion of said piston of said pressure compensation valve with a tank, and a shuttle valve supplying the pressure of a higher pressure side among the load pressure and the actuator port pressure to said compensation pressure acting portion of said pressure compensation valve.

2. An operating valve assembly with a pressure compensation valve, as set forth in claim 1, wherein said pilot valve cooperates with said spool and is placed at a communicating position when said output port is communicated with said main talk port.

3. An operating valve assembly with a pressure compensation valve, as set forth in either claim 1 or 2, wherein said shuttle valve is provided within said piston.

* * * * *